US009956601B2

(12) United States Patent
Schneider et al.

(10) Patent No.: US 9,956,601 B2
(45) Date of Patent: May 1, 2018

(54) PILOT ASSEMBLY HAVING AN INTEGRATED STRIPPER THAT MAY BE COAXIAL WITH A PILOT

(71) Applicant: Dayton Progress Corporation, Dayton, OH (US)

(72) Inventors: Peter Nikolaus Schneider, Tholey (DE); Richard Everett Del Grosso, II, Kettering, OH (US); Shrinidhi Chandrasekharan, Dayton, OH (US); Frederick Charles Wilkinson, Oberursel/Ts. (DE)

(73) Assignee: Dayton Progress Corporation, Dayton, OH (US)

( * ) Notice: Subject to any disclaimer, the term of this patent is extended or adjusted under 35 U.S.C. 154(b) by 1368 days.

(21) Appl. No.: 13/855,347

(22) Filed: Apr. 2, 2013

(65) Prior Publication Data

US 2013/0255350 A1 Oct. 3, 2013

Related U.S. Application Data

(60) Provisional application No. 61/619,103, filed on Apr. 2, 2012.

(51) Int. Cl.

| | |
|---|---|
| ***B21D 45/08*** | (2006.01) |
| ***B21D 43/00*** | (2006.01) |
| ***B21D 45/00*** | (2006.01) |

(52) U.S. Cl.

CPC ..... *B21D 45/08* (2013.01); *B21D 43/003* (2013.01); *B21D 45/00* (2013.01)

(58) Field of Classification Search

CPC ... B25B 11/02; B25B 11/2484; B25B 27/304; B25B 24/302; B25B 24/306; B21D 45/006; B21D 28/34; B21D 28/26; B21D 37/10; B21D 45/08; B21D 43/003; B21D 45/00; B21D 43/06; B21D 43/05; B21D 45/06;

(Continued)

(56) References Cited

U.S. PATENT DOCUMENTS

| | | | |
|---|---|---|---|
| 928,256 | A | 7/1909 | Grissom |
| 1,723,935 | A | 8/1929 | Henricson |

(Continued)

FOREIGN PATENT DOCUMENTS

| | | | | |
|---|---|---|---|---|
| EP | 1547703 | A1 * | 6/2005 | ..... B21D 45/006 |
| JP | 2005177823 | A | 7/2005 | |

OTHER PUBLICATIONS

EP1547703A1 is attached.*

*Primary Examiner* — Peter DungBa Vo
*Assistant Examiner* — John S Lowe
(74) *Attorney, Agent, or Firm* — Wood Herron & Evans LLP

(57) ABSTRACT

A pilot assembly includes a body portion including an outer surface and an opening defined in the outer surface. A pilot is configured for extending through an alignment hole in a sheet of material and is coupled with the body portion. A shaft of the pilot extends through the opening and beyond the outer surface. A stripper includes a bushing and a resilient biasing member. The bushing is configured for moving with respect to the main body portion and the pilot to push the sheet of material off of the pilot. The resilient biasing member is situated within the body portion and is compressed when the bushing engages the sheet of material.

14 Claims, 4 Drawing Sheets

(58) Field of Classification Search
CPC ..... Y10T 83/2155; Y10T 83/2159; Y10T 83/2166; Y10T 83/2157; B26D 7/1818
See application file for complete search history.

(56) References Cited

U.S. PATENT DOCUMENTS

| | | | | |
|---|---|---|---|---|
| 2,151,119 | A | 3/1939 | Kiwi | |
| 2,168,377 | A | 8/1939 | Wales | |
| 2,230,043 | A | 1/1941 | Moran | |
| 2,562,267 | A | 7/1951 | Granberg | |
| 3,485,122 | A | 12/1969 | Achler | |
| 4,215,608 | A * | 8/1980 | Herlan | B21D 45/006 83/139 |
| 4,856,393 | A | 8/1989 | Braddon | |
| 4,862,782 | A | 9/1989 | Ernst | |
| 4,993,295 | A | 2/1991 | Dacey, Jr. | |
| 5,709,019 | A | 1/1998 | Sawdon | |
| 5,992,285 | A | 11/1999 | Talarico | |
| 7,581,475 | B2 | 9/2009 | Moellering | |
| 8,087,333 | B2 | 1/2012 | Oishi | |
| 8,955,364 | B2 * | 2/2015 | Breen | B21D 28/34 72/344 |
| 9,289,815 | B2 * | 3/2016 | Breen | B21D 37/08 |
| 2006/0060046 | A1 | 3/2006 | Sugizaki et al. | |
| 2006/0071062 | A1 | 4/2006 | Weigelt | |
| 2010/0218656 | A1 | 9/2010 | Moellering | |

* cited by examiner

PILOT ASSEMBLY HAVING AN INTEGRATED STRIPPER THAT MAY BE COAXIAL WITH A PILOT

CROSS-REFERENCE TO RELATED APPLICATIONS

This application claims the benefit of U.S. Provisional Application No. 61/619,103, filed Apr. 2, 2012, the disclosure of which is hereby incorporated by reference herein in its entirety.

BACKGROUND

The invention generally relates to devices for use during a stamping operation, such as a pilot device used in a stamping machine, such as a press, to locate a sheet of material as part of a manufacturing process. More particularly, the invention relates to a pilot assembly having a stripper device for separating the sheet of material from the pilot assembly after the stamping operation is performed in the stamping machine.

In certain manufacturing processes, a stamping machine, such as a press, is used to cut or shape a sheet of material. For example, a press can be used to cut or shape a sheet of sheet metal. Stamping machines can include a number of tools, such as dies, for cutting or forming, and it is often important to align a sheet of material with respect to those tools. Pilot devices are used to align, or locate, a sheet of material with respect to the stamping machine. For example, a sheet of material can be provided with alignment holes, and a pilot device can include one or more shafts that are configured to fit within the alignment holes. When the sheet of material is moved into an initial position with respect to the stamping machine, the pilot device can be used to move the sheet of material into a specific alignment position with respect to the stamping machine. The pilot device can also be used to hold the sheet of material in a fixed position during a stamping operation. The shafts of the pilot device can include rounded and tapered ends for engaging with the alignment holes in a sheet of material, thereby accommodating slight variability in the initial position of the sheet of material A stamping machine uses substantial forces to cut or shape a sheet of material. These substantial forces can sometimes cause a sheet of material to stick to a component of a stamping machine, such as a pilot device, following a stamping operation. In addition, alignment holes in a sheet of material can be closely sized with respect to the shafts of a pilot device, and the alignment holes can tightly grip the shafts during and after a stamping operation. So-called stripping or stripper devices have been developed to address the problem of separating a sheet of material from a stamping machine following a stamping operation.

A need remains, however, for improvements relating to separating a sheet of material from a pilot device after a stamping operation.

BRIEF SUMMARY

According to an embodiment of the invention, a pilot assembly includes a body portion extending along an axial direction between a first end and a second end and including an outer surface at the first end. An opening is defined in the outer surface of the body portion. The pilot assembly further includes a pilot configured for extending through an alignment hole in a sheet of material for locating the sheet of material with respect to a stamping machine. The pilot is coupled with the body portion and has a shaft and a tip having a rounded end. The shaft extends in the axial direction through the opening in the body portion and beyond the outer surface. The tip is positioned outside the body portion and spaced from the outer surface. The pilot assembly further includes a bushing configured for moving with respect to the body portion and the pilot to push the sheet of material off of the pilot. The bushing includes a first portion confined within the body portion and a second portion extending through the opening and having an engagement surface configured for engaging the sheet of material. The pilot assembly further includes a resilient biasing member situated within the body portion and engaging the bushing. The biasing member is configured to be compressed as the engagement surface of the bushing engages the sheet of material.

BRIEF DESCRIPTION OF THE SEVERAL VIEWS OF THE DRAWINGS

The accompanying drawings, which are incorporated in and constitute a part of this specification, illustrate various embodiments of the invention and, together with a general description of the invention given above and the detailed description of the embodiments given below, serve to explain the embodiments of the invention.

DETAILED DESCRIPTION

Figure 1:
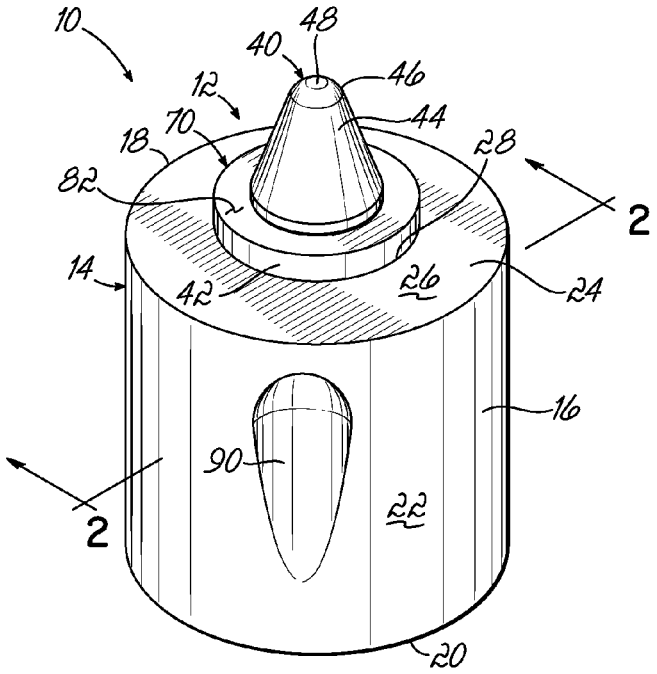
FIG. 1 is an isometric view showing a pilot assembly constructed according to an embodiment of the present invention and including pilot and a stripper.
Figure 2:
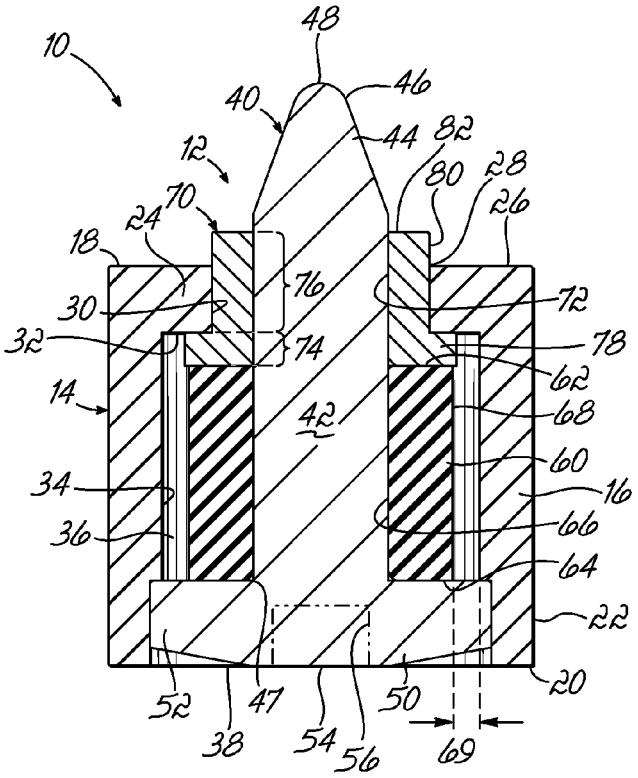
FIG. 2 is a cross-sectional view taken generally along line 2-2 in FIG. 1.

Referring first to FIGS. 1 and 2, a pilot assembly, generally indicated by reference numeral 10 includes a stripper, generally indicated by reference numeral 12. The pilot assembly 10 is mounted in a die button 14, which may optionally be considered part of the assembly 10 as well. In the embodiment shown, the die button 14 includes a main body portion 16 that is generally cylindrical and extends between a first end 18 and a second end 20. An axial direction of the main body portion 16 is defined along an axis extending between the first and second ends 18, 20, and generally corresponds with a length of the main body portion 16. The main body portion 16 includes a generally cylindrical outer surface 22. An annular lip 24 extends radially inward proximate the first end 18 of the main body portion 16 and defines an outer surface 26. A generally cylindrical opening, or bore, 28 is defined in the outer surface 26, and a bore surface 30 extends axially from the outer surface toward the second end 20. The annular lip 24 also includes a ledge 32 opposite from the outer surface 26 and extending between the bore surface 30 and the main body portion 16. The main body portion 16 also includes an inner surface 34 between the first end 18 and the second end 20. As shown, the inner surface 34 is generally cylindrical. An interior cavity 36 is provided within the main body portion 16 of the die button 14 and is generally defined by the ledge 32 and the inner surface 34. The main body portion 16 also includes an annular base surface 38 proximate the second end 20.

The pilot assembly 10 further includes a pilot 40, a resilient biasing member 60, and a bushing 70. The bushing 70 and the resilient biasing member 60 comprise active elements of the stripper 12. The pilot assembly 10 lacks any structure, such as a threaded plug engaging the die button 14, holding the pilot 40 in engagement with the resilient biasing member 60 such that the resilient biasing member 60 can be preloaded.

The pilot 40 of the pilot assembly 10 is coupled with the main body portion 16 of the die button 14. The pilot 40 is configured to extend through an alignment hole in a sheet of material for locating the sheet of material with respect to an associated stamping machine. The pilot 40 includes a generally cylindrical shaft 42 that extends from within the interior cavity 36 along the axial direction of the main body portion 16 and through the opening 28. The shaft 42 of the pilot 40 is generally coaxial with the opening 28 and terminates in a tip 44 at a first end 46, which is outside the main body portion 16. The tip 44 of the pilot 40 tapers radially inwardly from the shaft 42, is generally conical-shaped, and includes a rounded end or nose 48. A portion of the shaft 42 extends past the outer surface 26 of the die button 14, and the tip 44 extends from that portion. Thereby, the tip 44 is spaced from the outer surface 26. The shaft 42 of the pilot 40 is connected at a second end 47 thereof to a head 50, which is generally within the interior cavity 36. The head 50 of the pilot 40 extends radially from the shaft 42 to form a flange 52 that contacts the main body portion 16. For example, the head 50 can be press fit into the main body portion 16, such that the flange 52 contacts the inner surface 34 of the main body portion 16, as shown. As shown, a base surface 54 of the head 50 is generally coplanar with the annular base surface 38 of the main body portion 16. The head 50 of the pilot 40 may optionally include a precision ground hole 56 intersecting surface 54 and aligned with the centerline of the pilot 40 that is configured to receive a dowel pin for alignment purposes.

The resilient biasing member 60 of the pilot assembly 10 is provided around the shaft 42 of the pilot 40 and inside the interior cavity 36 of the die button 14. In some embodiments, the biasing member 60 is a spring elastic member, such as a urethane spring, and is selected to give a desired spring force. Alternatively, the biasing member 60 may comprise a mechanical mechanism such as a compression spring having coils arranged to provide a resilient bias or one or more Belleville washers. The biasing member 60 is generally cylindrical and extends between a first end 62 and a second end 64. The biasing member 60 is configured to compress under a load and to expand once the load is released, the compression and expansion being generally along the axial direction of the main body portion 16.

The biasing member 60 of the pilot assembly 10 is generally coaxial with the shaft 42. An interior surface 66 of the biasing member 60 is generally adjacent the shaft 42. An exterior surface 68 of the biasing member 60 opposite the interior surface 66 is spaced from the inner surface 34 of the main body portion 16 by a distance to define an expansion space 69. The expansion space 69 is sized and configured to accommodate expansion of the biasing member 60 as the biasing member 60 is compressed. When the biasing member 60 is compressed, it may swell or expand into the clearance provided by the expansion space 69. Near its second end 64, the biasing member 60 is generally adjacent the flange 52 of the head 50. Near its first end 62, the biasing member 60 is generally adjacent the bushing 70.

The bushing 70 of the pilot assembly 10 is configured for moving with respect to the main body portion 16 and the pilot 40 to push a sheet of material off of the pilot 40. The bushing 70 is provided in a coaxial arrangement around the shaft 42 and is configured to move along the axial direction of the shaft 42. In particular, the bushing 70 includes an inner surface 72 that is generally adjacent the shaft 42. The bushing 70 includes a first portion 74 that is generally confined within the interior cavity 36, and a second portion 76 that extends in the opening 28. The first and second portions 74, 76 are connected, as shown. The first portion 74 includes a shoulder 78 that is configured to engage the ledge 32 of the main body portion 16. The second portion 76 includes an outer portion 80 that is configured to abut the bore surface 30 and slide within the opening 28 of the main body portion 16. The second portion 76 extends through the opening 28 in the main body portion 16 and terminates at an engagement surface 82 that is configured to engage a sheet of material. The engagement surface 82 is generally annular-shaped and is generally parallel with the outer surface 26 of the die button 14. The resilient biasing member 60 is captured between the second portion 76 of the bushing 70 and the flange 52 of the pilot 40.

In some embodiments, the bushing 70 of the pilot assembly 10 may be comprised of brass, which is softer than the materials with which the pilot assembly 10 is typically used. Accordingly, contact between the bushing 70 and sheet is less likely to cause a cosmetic blemish on the surface of a material. The bushing 70 could also be made of any suitable material. The bushing 70 preferably has a non-threaded coupling with the die button 14 that secures the die button 14 and bushing 70 together. As a result, the annular lip in the form of outer surface 26 does not need any type of structural feature to permit the establishment of a threaded engagement between the pilot assembly 10 and the die button 14, and the outer surface 26 of the annular lip 24 is not restricted for this reason in size and shape.

In use, the pilot assembly 10 is used to positively locate and align a sheet of material, such as sheet metal, for example, with respect to a stamping machine. The pilot assembly 10 holds the sheet of material while a stamping operation is performed on the sheet of material with one or more other tools, such as dies. In particular, the pilot 40 is received in an alignment hole of the sheet of material. In this manner, the pilot 40 reproducibly locates each successive sheet of material that is subjected to the stamping operation. Before the stamping operation, the working length of the pilot 40 extends beyond the one or more tools used to perform the stamping operation, that way the pilot 40 reaches the sheet of material before the one or more tools. In addition, before the pilot 40 is moved into holding engagement with the sheet of material, the biasing member 60 is generally uncompressed in the pilot assembly 10, and the bushing 70 extends beyond the outer surface 26, as is shown in FIGS. 1 and 2.

Under a force applied by an associated stamping machine, such as a press, the pilot assembly 10 is moved toward the sheet of material. The pilot 40 is directed toward, and the tip 44 of the pilot 40 enters, an alignment hole in the sheet of material. With continued application of force, the pilot 40 moves further within the alignment hole and the engagement surface 82 of the bushing 70 comes into contact with the sheet of material generally adjacent the alignment hole. With continued application of force, the sheet of material and the bushing 70 are pushed together, and the bushing 70 is caused to move relative to the shaft 42. In particular, the engagement surface 82 bears against the sheet of material, and the first portion 74 bears against the first end 62 of the biasing member 60. The bushing 70 moves along the shaft 42 toward the second end 47 thereof, and the biasing member 60 is compressed by this movement of the bushing 70. With continued application of force, the biasing member 60 continues to be compressed until the engagement surface 82 of the bushing 70 reaches a flush position with the outer surface 26. When the engagement surface 82 reaches a flush position with the outer surface 26, further application of force ceases to move the bushing 70 relative to the shaft 42.

The biasing member 60 stores potential energy in its compressed condition. As the pilot 40 continues through the sheet of material, the pilot 40 enters a matrix or a die beneath the material sheet. With the position of the sheet of material established with precision by the engagement between the pilot 40 and alignment hole, the other tools then perform the stamping operation on the sheet of material.

After the stamping operation concludes, the stamping machine moves the other tools and the pilot assembly 10 in a direction away from the sheet of material so as to withdraw the pilot 40 from the alignment hole and retract the pilot assembly 10 away from the sheet of material. A restorative force from the release of the stored potential energy in the biasing member 60 pushes the bushing 70 back toward the first end 46 of the shaft 42. In particular, the biasing member 60 pushes the bushing 70 toward the first end 46 until the shoulder 78 of the bushing 70 comes into engagement with the ledge 32 of the main body portion 16. The bushing 70 thereby contacts and pushes the sheet of material in a direction away from the die button 14. In particular, the engagement surface 82 of the bushing 70 engages the sheet of material and pushes the sheet of material away from the outer surface 26. Thereby, the stripper 12, including the biasing member 60 and the bushing 70, strips the sheet of material from the pilot assembly 10 and prevents the sheet of material from lifting with the pilot 40 as the pilot assembly 10 is moved away from the sheet of material. The pilot assembly 10 and, in particular, the outer surface 26 of the die button 14, is eventually moved out of contacting relationship with the sheet of material by the stripper 12 and the movement of the pilot assembly 10 away from the sheet of material. At some point when the pilot assembly 10 is moved away from the sheet of material, the biasing member 60 is restored to its initial uncompressed shape. After the sheet of material is released from the pilot assembly 10, the sheet of material can be moved by a feeder device away from the stamping machine. Another sheet of material can then be moved into position with respect to the stamping machine for a similar stamping operation.

An alignment hole in a sheet of material may be closely sized to the shaft 42 of the pilot 40, and therefore the sheet of material can grip the shaft 42. The configuration of the bushing 70 or the main body portion 16 of the pilot assembly 10, or both, can be adjusted to provide different arrangements for stripping the sheet of material from the pilot assembly 10. In particular, the relationship between the bushing 70 and the pilot 40 can be adjusted to provide differing stripping characteristics. Three general possibilities are contemplated.

First, and as shown in the figures, when the shoulder 78 of the bushing 70 engages the ledge 32 of the main body portion 16, the second portion 76 of the bushing 70 extends through the opening 28 of the main body portion 16 along the shaft 42 and the engagement surface 82 of the bushing 70 is near generally where the tip 44 begins. This position, with the shoulder 78 engaging the ledge 32, represents the maximum extent the bushing 70 can move along the shaft 42 toward the tip 44. Therefore, this position also represents the position to which the bushing 70 can push a sheet of material with respect to the pilot 40. Thus, in this first possibility, the bushing 70 can push a sheet of material along the shaft 42 toward the tip 44 to a point generally near where the tip 44 begins.

A second possibility is a configuration where the engagement surface 82 of the bushing 70 can reach a point on the shaft 42 that is generally co-extensive with, or beyond, the tip 44. With such a configuration, the bushing 70 could push a sheet of material along the shaft 42 toward and to (or beyond) the tip 44.

A third possibility is a configuration where the engagement surface 82 does not extend to, or near, the tip 44, and instead is between the tip 44 and the outer surface 26. With such a configuration, the bushing 70 could push a sheet of material along the shaft 42 toward, but not to, the tip 44. Depending on how tightly a sheet of material grips the shaft 42, any of these general possibilities may be appropriate.

The pilot assembly 10 and die button 14 may be retrofitted for use with an existing retainer and, in that sense, may be combined with a retainer formerly used with a conventional pilot as a replacement for the conventional pilot.

The die button 14 includes structure for securely positioning it with respect to a retainer, such as what is shown and described below with respect to FIGS. 5 and 6. In particular, the die button 14 includes a ball seat 90 that is configured to receive a spring-loaded locking ball of a ball lock mechanism of an associated retainer. Such a ball lock securely positions the die button 14 with respect to the retainer. The ball seat 90 is formed in the main body portion 16, extends generally diagonal therein with respect to the axial direction, and may be oblong shaped or teardrop shaped.

Figure 3:
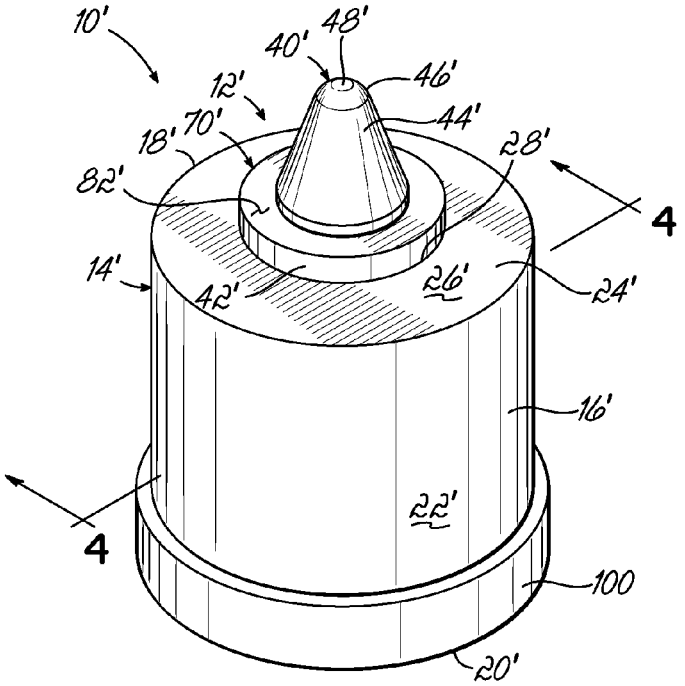
FIG. 3 is an isometric view showing a pilot assembly constructed according another embodiment of the invention.
Figure 4:
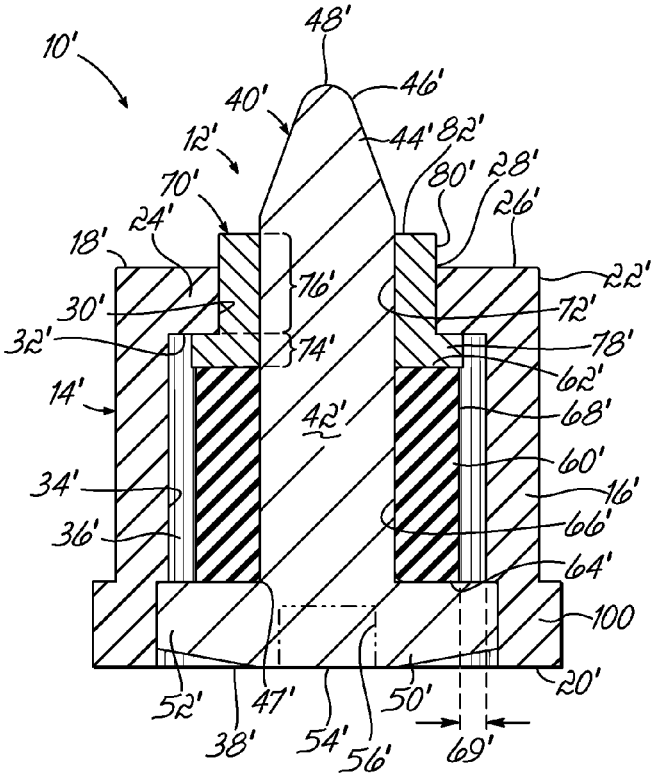
FIG. 4 is a cross-sectional view taken generally along line 4-4 in FIG. 3.

Another pilot assembly 10' is shown in FIGS. 3 and 4 and is substantially similar to the pilot assembly 10 shown in FIGS. 1 and 2, other than the structure for securing it with respect to a retainer device. Whereas the pilot assembly 10 includes the ball seat 90, the pilot assembly 10' includes a flange 100 proximate the second end 20' of a main body portion 16'. The flange 100 is configured to mate with a corresponding shelf formed in a retainer, and the engagement of the flange 100 with the corresponding shelf securely positions the die button 14 with respect to the retainer device.

Figure 5:
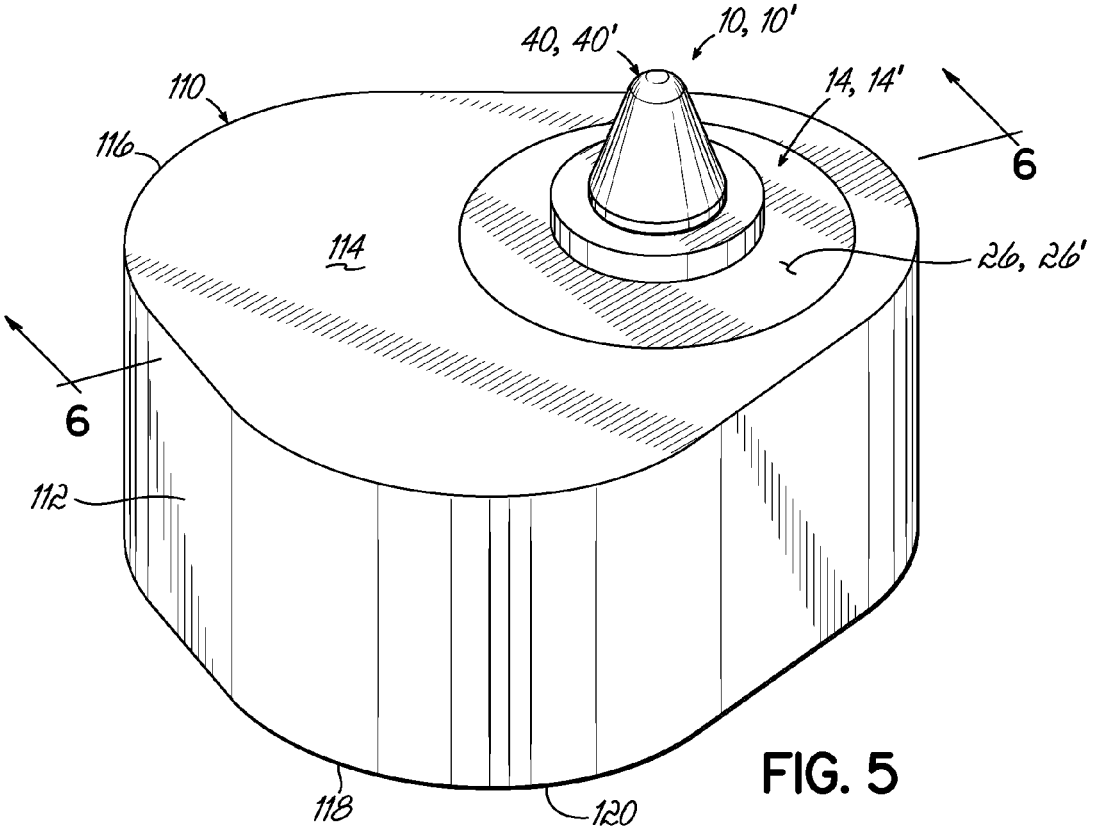
FIG. 5 is an isometric view showing a retainer having either of the pilot assemblies of FIGS. 1-2 or FIGS. 3-4 removably installed therein.
Figure 6:
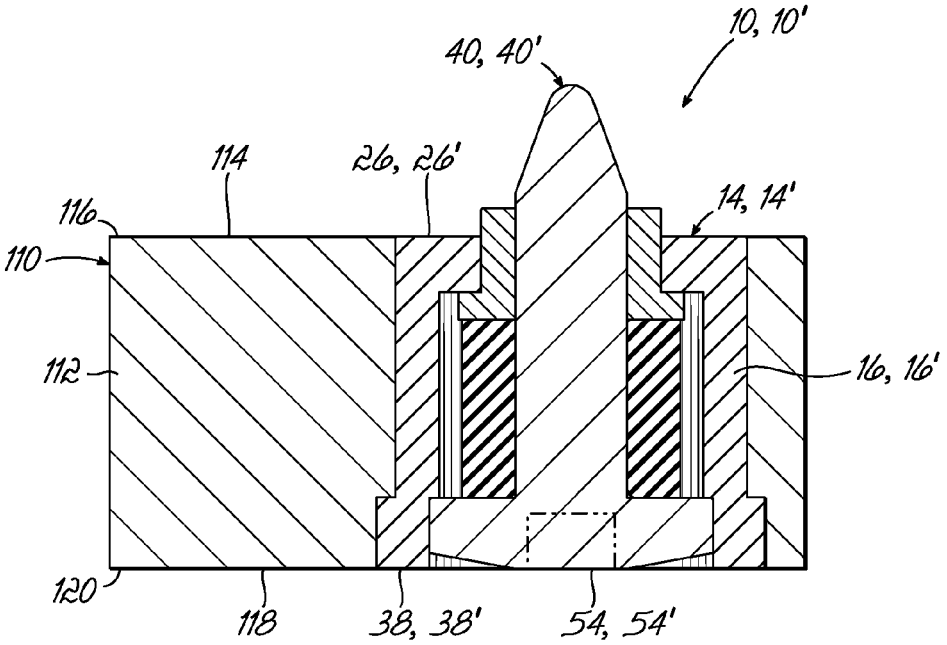
FIG. 6 is a cross-sectional view taken generally along line 6-6 in FIG. 5.

Turning to FIGS. 5 and 6, either of the pilot assemblies 10 or 10' can be mounted in a retainer 110, as shown, which may also optionally be considered part of the assemblies 10, 10'. The retainer 110 is of a type commonly used in stamping operations, and includes a main body portion 112 having a generally triangular prism shape. A main surface 114 is defined at a first end 116 of the main body portion 112, and the die buttons 14, 14' are configured to fit within the main body portion 112 so the outer surfaces 26, 26' thereof are generally flush with the main surface 114. A back surface 118 is defined at a second end 120 of the main body portion 112. The base surfaces 38, 38' of the main body portions 16, 16' and the base surfaces 54, 54' of the pilots 40, 40' are generally flush with the back surface 118. The die button 14 may be secured with the retainer 110 using a ball-lock mechanism or the die button 14' may be secured with the retainer 110 using a backing plate.

Figure 7:
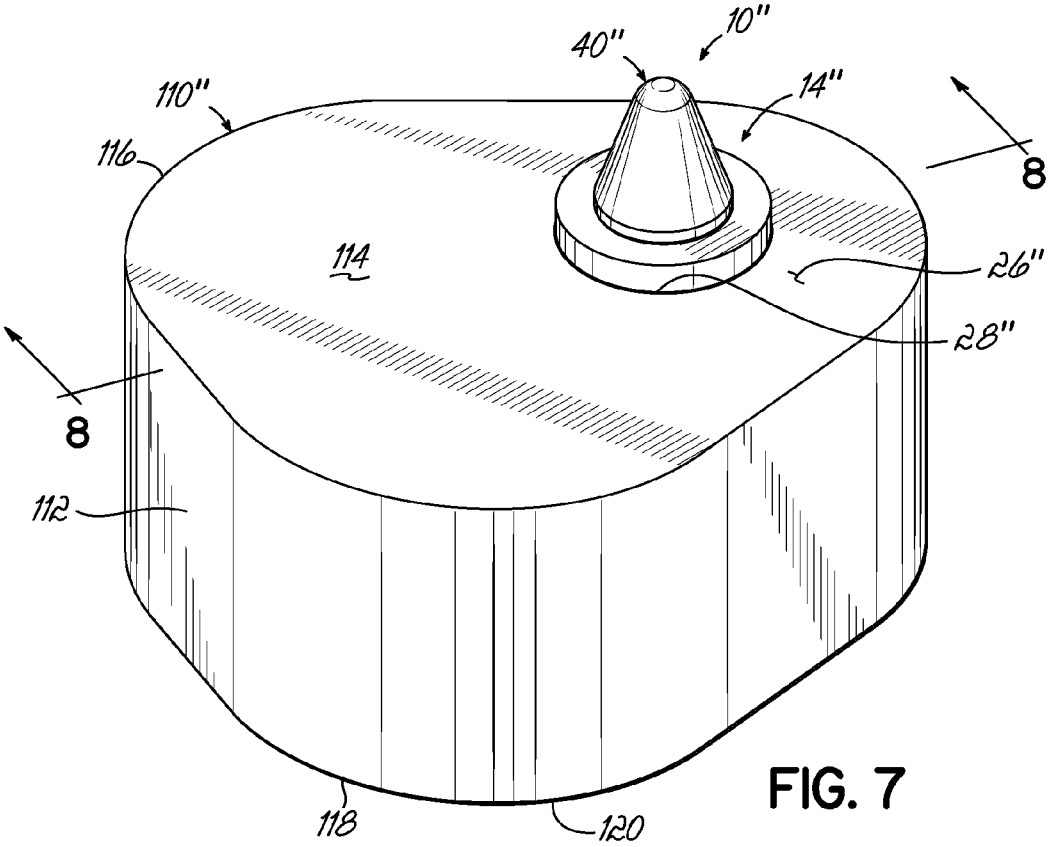
FIG. 7 is an isometric view showing a pilot assembly constructed according to another embodiment of the invention.
Figure 8:
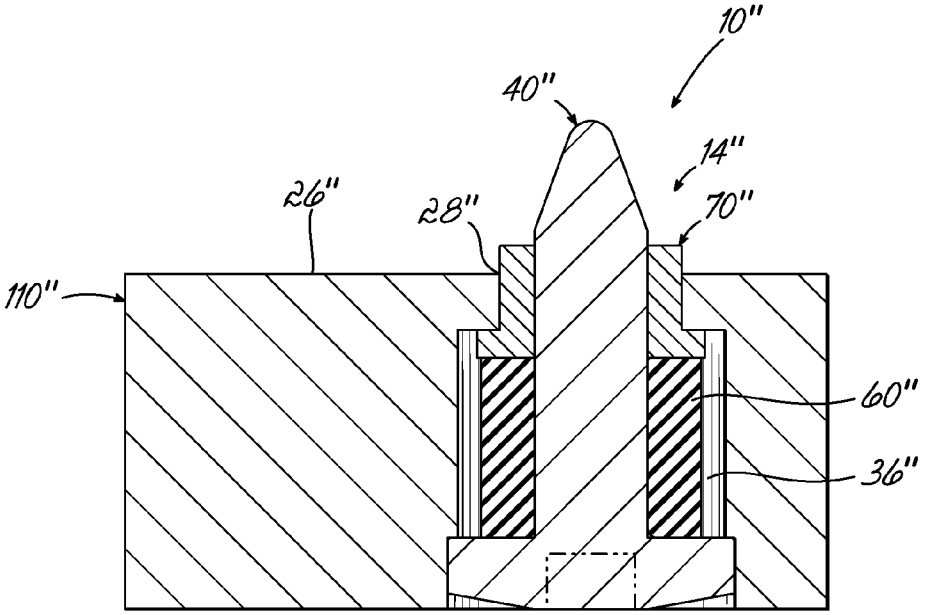
FIG. 8 is a cross-sectional view taken generally along line 8-8 in FIG. 7

Yet another pilot assembly 10" is shown in FIGS. 7 and 8 and includes a stripper 12" mounted in a retainer 110". For example, the head of a pilot 40" can be press fit into the retainer 110". The press fit is an interference fit between the pilot 40" and retainer 110" that secures the pilot 40" with the retainer 110" by friction after the pilot 40" and retainer 110" are pushed together, rather than by any type of fastener. The pilot 40" may be removed from the retainer 110" by an appropriate application of force directed to remove the pilot 40" from the retainer 110".

The retainer 110" includes features corresponding to the main body portions 16, 16' of the die buttons 14, 14'. For example, the retainer 110" could define a surface 26" similar to outer surfaces 26, 26', an opening 28" similar to openings 28, 28', and an interior cavity 36" similar to interior cavities 36, 36'. A pilot 40" similar to pilots 40, 40', a biasing member 60" similar to biasing members 60, 60', and a bushing 70" similar to bushings 70, 70' can be incorporated therein in a manner similar to what is disclosed above.

In addition to the context of a pilot assembly, it is contemplated that the stripper functions performed by the structure disclosed herein are equally applicable to other stamping operations, such as coining, forming, and piercing, to name a few. For example, another tool (for coining, forming, or piercing) can replace the pilot 40 for use with the remainder of the assembly 10.

References herein to terms such as "vertical", "horizontal", etc. are made by way of example, and not by way of limitation, to establish a frame of reference. Terms, such as "on", "above", "below", "side", "upper", "lower", "over", "beneath", and "under", are defined with respect to a horizontal plane. It is understood that various other frames of reference may be employed for describing the invention without departing from the spirit and scope of the invention. It is also understood that features of the invention are not necessarily shown to scale in the drawings.

It will be understood that when an element as a layer, region or substrate is described as being "on" or "over" another element, it can be directly on or over the other element or intervening elements may also be present. In contrast, when an element is described as being "directly on" or "directly over" another element, there are no intervening elements present. It will also be understood that when an element is described as being "attached", "connected", or "coupled" to another element, it can be directly connected or coupled to the other element or intervening elements may be present. In contrast, when an element is described as being "directly attached", "directly connected", or "directly coupled" to another element, there are no intervening elements present. It is also understood that features of the present invention are not necessarily shown to scale in the drawings.

While the invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method, and illustrative example shown and described.

What is claimed is:

1. A pilot assembly, comprising:

a body portion extending along an axial direction between a first end and a second end, the body portion including an outer surface at the first end and an opening defined in the outer surface;

a pilot configured for extending through an alignment hole in a sheet of material for locating the sheet of material with respect to a stamping machine, the pilot being coupled with the body portion and having a shaft and a tip having a rounded end, the shaft extending in the axial direction through the opening in the body portion and beyond the outer surface, and the tip being positioned outside the body portion and spaced from the outer surface, wherein the pilot further includes a head coupled with and extending radially from the shaft at the second end, the head being coupled by a press fit arrangement into the body portion;

a bushing positioned between the body portion and the shaft of the pilot, said bushing configured for moving with respect to the body portion and the pilot to push the sheet of material off of the pilot, the bushing including a first portion confined within the body portion and a second portion extending through the opening and having an engagement surface configured for engaging the sheet of material; and a resilient biasing member situated completely within the body portion by engaging and being captured between the bushing and the head of the pilot, the biasing member being configured to be compressed as the engagement surface of the bushing engages the sheet of material.

2. The pilot assembly of claim 1, wherein the body portion includes a ledge near the first end, the first portion of the bushing includes a shoulder configured to engage the ledge, and the bushing is confined in the body portion by engagement between the shoulder and the ledge.

3. The pilot assembly of claim 2, wherein the engagement surface of the bushing is generally near the tip of the pilot when the shoulder of the bushing engages the ledge of the body portion.

4. The pilot assembly of claim 2, wherein the engagement surface of the bushing is generally co-extensive with the tip of the pilot when the shoulder of the bushing engages the ledge of the body portion.

5. The pilot assembly of claim 2, wherein the engagement surface of the bushing extends beyond the tip of the pilot when the shoulder of the bushing engages the ledge of the body portion.

6. The pilot assembly of claim 2, wherein the engagement surface of the bushing is generally between the tip of the pilot and the outer surface of the body portion when the shoulder of the bushing engages the ledge of the body portion.

7. The pilot assembly of claim 1, wherein the bushing and the biasing member are coaxial with the pilot.

8. The pilot assembly of claim 1, wherein the biasing member is a spring elastic member.

9. The pilot assembly of claim 8, wherein the spring elastic member is a urethane spring.

10. The pilot assembly of claim 1, wherein the body portion includes an inner surface and the biasing member includes an exterior surface, and wherein an expansion space is defined within the body portion between the inner surface of the body portion and the exterior surface of the biasing member, the expansion space being configured to accommodate radial expansion of the biasing member as the biasing member is compressed along an axial direction of the body portion.

11. The pilot assembly of claim 1, wherein the body portion includes a die button configured to be removably mounted in a retainer.

12. The pilot assembly of claim 1, the body portion includes a die button, and further comprising:

a retainer having a retainer body portion with an end and a main surface at the end, wherein the die button is removably mounted in the retainer and the outer surface of the of the die button is generally flush with the main surface of the retainer.

13. The pilot assembly of claim 1, wherein the body portion includes a retainer having a generally triangular prism shaped retainer body portion.

14. A pilot assembly, comprising:

a body portion extending along an axial direction between a first end and a second end, the body portion including an outer surface at the first end and an opening defined in the outer surface;

a pilot configured for extending through an alignment hole in a sheet of material for locating the sheet of material with respect to a stamping machine, the pilot being coupled with the body portion and having a shaft and a tip having a rounded end, the shaft extending in the axial direction through the opening in the body portion and beyond the outer surface, and the tip being positioned outside the body portion and spaced from the outer surface;

a bushing configured for moving with respect to the body portion and the pilot to push the sheet of material off of the pilot, the bushing including a first portion confined within the body portion and a second portion extending through the opening and having an engagement surface configured for engaging the sheet of material; and a resilient biasing member situated within the body portion and engaging the bushing, the biasing member being configured to be compressed as the engagement surface of the bushing engages the sheet of material, wherein the bushing comprises brass.

* * * * *